US005157881A

United States Patent [19]

Tashman et al.

[11] Patent Number: 5,157,881

[45] Date of Patent: Oct. 27, 1992

[54] REPLACEMENT WINDOW CONSTRUCTION AND METHOD

[75] Inventors: Fred F. Tashman, Scottsdale; Dale Bargman, Gilbert, both of Ariz.

[73] Assignee: Tashco Industries, Inc., Gilbert, Ariz.

[21] Appl. No.: 709,171

[22] Filed: Jun. 3, 1991

[51] Int. Cl.[5] ..... E04B 1/08; E04C 1/12

[52] U.S. Cl. ..... 52/98; 52/204; 52/476; 52/656; 52/738

[58] Field of Search ..... 52/98-100, 52/737-740, 656, 476, 204; 49/453, 380

[56] References Cited

U.S. PATENT DOCUMENTS

| | | | |
|---|---|---|---|
| 2,509,582 | 5/1950 | Webster | 49/453 |
| 2,587,471 | 2/1952 | Hess | 49/453 |
| 2,595,016 | 4/1952 | Spector et al. | 49/380 |
| 2,641,805 | 6/1953 | Spector et al. | 52/98 |
| 4,193,238 | 3/1980 | Chalmers et al. | 52/211 |
| 4,196,545 | 4/1980 | Korany et al. | 49/463 |
| 4,335,550 | 6/1982 | Johnson | 52/656 |
| 4,341,048 | 7/1982 | Minter | 52/217 |
| 4,430,831 | 2/1984 | Kemp | 52/211 |
| 4,558,536 | 12/1985 | Dunsmoor | 49/404 |
| 4,590,723 | 5/1986 | Nassau et al. | 52/211 |
| 4,601,144 | 7/1986 | Tinti | 52/211 |

*Primary Examiner*—James L. Ridgill, Jr.
*Attorney, Agent, or Firm*—LaValle D. Ptak

[57] ABSTRACT

A replacement window frame assembly includes bottom, sectioned-top, and first and second side cap members for placement over an existing window frame in a building from which the windows and intermediate support members have been removed. The cap members are made from a uniform aluminum extrusion which has a front lip to extend over the outside of the existing frame, and a lower depending lip, designed to rest on the window sill, or abut against the side and top of the frame opening in which the original frame is placed. The cap members are placed over the existing window frame to form a flat mounting surface for the installation of a replacement window. The entire replacement may be effected from the outside of the building, and is accomplished without destroying or damaging any of the interior or exterior finishes of the building.

20 Claims, 2 Drawing Sheets

REPLACEMENT WINDOW CONSTRUCTION AND METHOD

BACKGROUND

Homeowners and building owners periodically desire to remodel existing structures by removing the existing windows and replacing them with new windows. In recent years, such remodeling has been particularly desirable in warmer climates of the United States, such as in the South and Southwest, where older buildings generally were constructed with relatively inexpensive aluminum-framed, single pane sliding windows. When energy costs were relatively low, the significant heat loss, which takes place through such windows, was not particularly costly. In recent years, however, energy costs have risen dramatically, and the energy loss through such aluminum-framed, single pane windows, particularly in the hot summer months, results in significantly increased utility bills. In addition, when such windows become old, the tracks sometimes become bent, and the operating mechanisms wear out, necessitating at least repair, if not full replacement of the windows.

Typically, the replacement of windows in a home or other building requires the removal of the existing window, and the frame in which it is mounted. Since window frames, in new construction, are "built into" the window opening, the removal of an existing window frame results in damage to at least one or the other of the interior and exterior finished surfaces surrounding the frame. This requires additional labor to refinish the interior and the exterior of the building around the window opening. The additional repair steps to do this significantly increase the cost of replacing windows, whenever the existing window frames are removed for replacement This is a significant disadvantage to replacing the windows, and frequently deters the homeowner or building owner from effecting such a replacement.

Patents have been granted for casing covers or cladding to refinish the exteriors of existing window frames. These are not directed to replacement windows; but simply are decorative protective covers to provide weather protection and appearance alterations of the window casings or window frames to which they are applied. Three such patents, disclosing window treatments of this type, are the patents to Chalmers No. 4,193,238; Minter No. 4,341,048; and Nassau No. 4,590,723. All of these patents provide Minter are directed to exterior casing coverings, and Nassau is directed to interior casing coverings.

The patent to Tinti No. 4,601,144 is directed to a design of interior wood trim for placement around the edge of a window frame to insulate the seam or gap between the rough opening and the window frame, to prevent the passage of air through this gap. The trim has a channel on its reverse side. The channel is filled with a compressible foam which presses against the adjacent structural members, and bridges the gap or seam between them to provide the desired insulating function.

It is desirable to provide a replacement window construction which can be used to economically and efficiently replace the windows in an existing building without damage to the interior or exterior finish of the building.

SUMMARY OF THE INVENTION

It is an object of this invention to provide an improved replacement window construction.

It is another object of this invention to provide an improved method for replacing windows in an existing building.

It is an additional object of this invention to provide an improved replacement window structure and method for replacing existing windows in a building without removing the existing window frame.

It is a further object of this invention to provide an improved window structure in which a new window frame in the form of cap extrusions is placed over the existing window frame for subsequent installation of the new window.

In accordance with a preferred embodiment of the invention, a replacement window frame assembly for use in remodeling buildings, in which the windows have been removed from existing window frames, is made of bottom, top, and first and second side jamb cap members, which extend over the existing window frame, and which have a front lip extending over the outside of the window frame. Each of the cap members has a rear edge which abuts the interior sill, top, and side walls on the structure surrounding the window frame. Once the cap members are attached in place over the existing window frame, a new window is installed in the new frame made of the cap members covering the old frame. Alternatively, for fixed frame or art glass applications, the glass may be directly glazed into the new frame.

DETAILED DESCRIPTION

Reference now should be made to the drawings, in which the same reference numbers are used throughout the different figures to designate the same or similar components.

Figure 1:
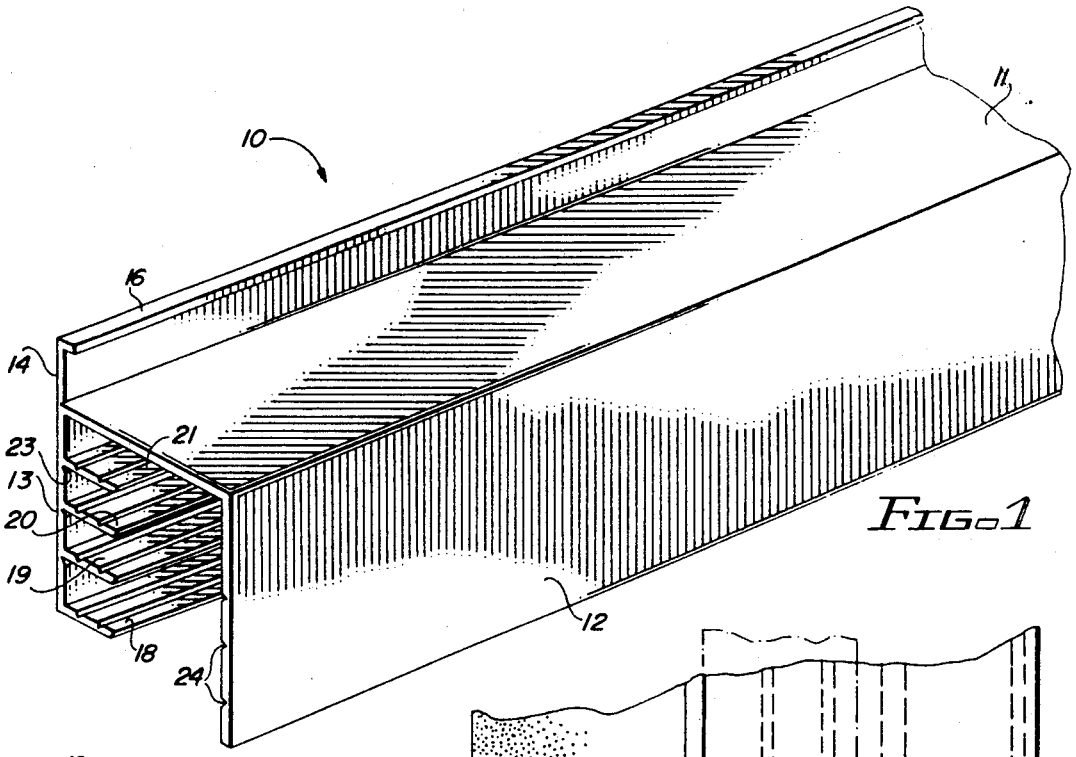
FIG. 1 is a perspective view of a component of a preferred embodiment of the invention.

FIG. 1 shows a perspective view of an elongated aluminum extrusion 10 which is constructed in accordance with a preferred embodiment of the invention. The extrusion 10 includes a flat upper surface 11, with a downwardly extending front lip 12 on one edge, and a downwardly extending rear surface or edge 13 attached to the other edge of the surface 11. Parallel with the surface 13 is an upwardly extending flange 14 having an inwardly turned edge 16 on it, as seen most clearly in FIGS. 1 and 2.

Figure 2:
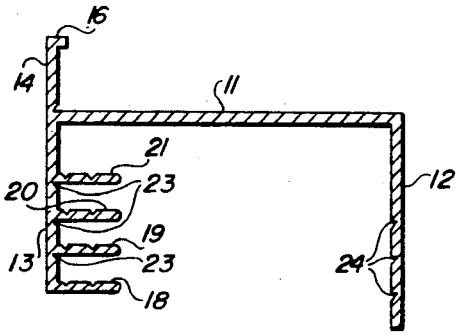
FIG. 2 is a cross section of the embodiment shown in FIG. 1.

As shown most clearly in FIG. 2, the front lip 12 has elongated score lines, or lines of weakening 24, extending throughout its length, parallel to the surface 11. Similarly, parallel lines of weakening 23 are provided at the same spaced distances apart as the lines 24, along the rear lip or edge 13. As also most clearly shown in FIGS. 1 and 2, the lowermost edge of the rear lip 13 has an inwardly turned leg 18 on it, and above each of the score lines 23, similar inwardly turned legs 19, 20, and 21 are provided. Each of these legs also have scored lines of weakening extending throughout their length parallel to the plane of the surfaces 13 and 14. This again is shown most clearly in FIGS. 1 and 2.

The extrusion shown in FIGS. 1 and 2 may be made of anodized aluminum, other suitable materials, or aluminum with an enameled or painted finish, as desired. Color and surface texture are selected to be complimentary to the installation with which the extrusions are to be used.

Figure 3:
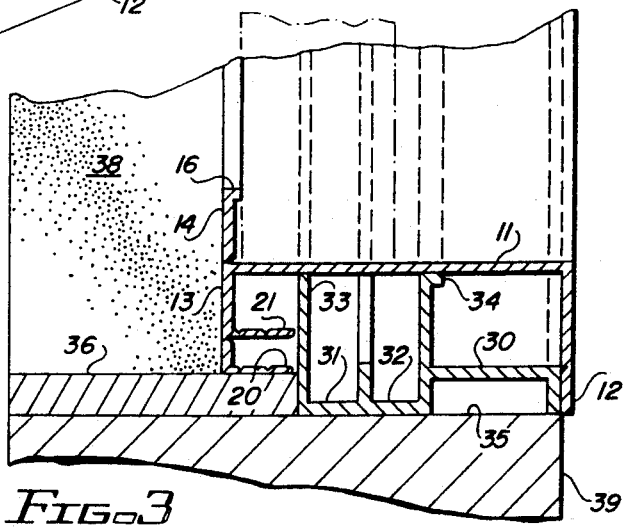
FIG. 3 shows the manner of installation of the embodiment of FIG. 1 in the practice of a preferred embodiment of the method of this invention.

As shown in FIG. 3, the extrusion of FIGS. 1 and 2 is made to fit over an existing aluminum or metal window frame 30, for sliding windows, and having a pair of window channels 31 and 32 in it. Typically, such a frame 30 includes inner and outer guide walls or flanges 33 and 34, respectively, which extend upwardly from the building opening 35 in which the frame 30 is installed. In addition, the window sill 36 of the building interior usually is fastened to the bottom of the opening 35 and abuts the flange 33, as illustrated in FIG. 3. Similar side walls 38 and a top interior finish, typically made of drywall or other material, abut against the inner facing surface of the flange 33 in the manner of the sill 36 in the completed installation of a window opening including the metal frame 30.

As illustrated in FIG. 3, once the old window sash and/or glass and center supports carried by the window frame 30 are removed, the extrusion of FIGS. 1 and 2 may be placed as a cap over the existing window frame 30 without removing the window frame 30 from the structure to which it was attached in the initial construction of the building. The score lines or weakening lines 23 and 24 are provided to accommodate different vertical heights of the flanges 33 and 34; so that the surface 11 is parallel to the plane of the opening in which the cap of FIGS. 1 and 2 is placed. As shown in FIG. 3, the bottom two sections of the rear lip 13, including the legs 18 and 19, have been broken away from the cap installed in FIG. 3; so that the inwardly turned leg 20 rests on the window sill 36. The lower surface of the flat portion 11 rests on the upper edges of the flanges 33 and 34. Similarly, the lip 12 on the outside of the building has been broken off at the second notch shown in FIG. 2, to extend over the existing frame 30 to the line of contact between the frame 30 and the outer surface 39 of the building wall. This is readily apparent from an examination or comparison of FIGS. 2 and 3.

Figure 4A:
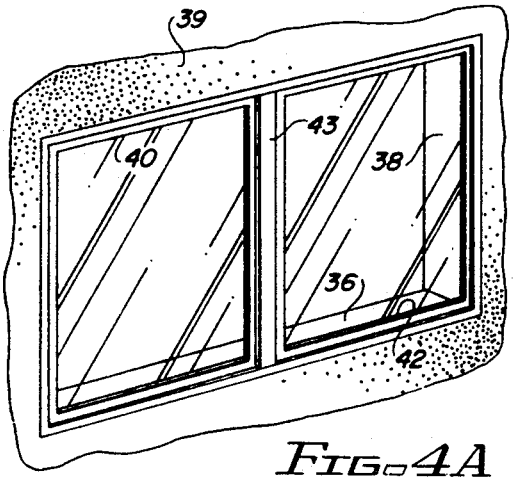
FIGS. 4A through 4G illustrate sequential steps in the practice of the method of the invention.
Figure 4B:
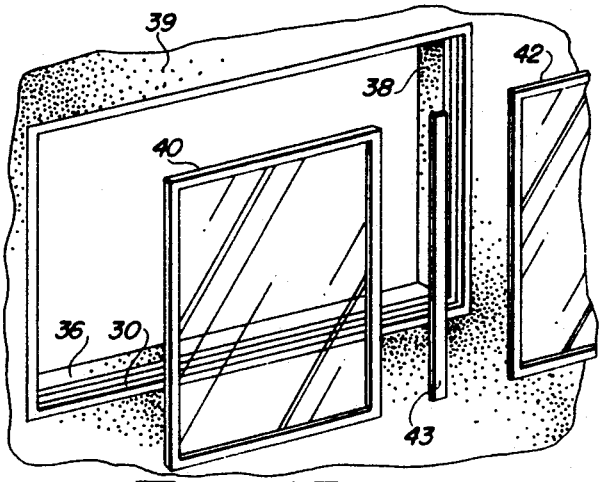

Reference now should be made to FIGS. 4A through 4G, which illustrate the method of installing the replacement window frame made from the extrusion shown in FIGS. 1 and 2. FIG. 4A shows an existing standard aluminum window frame 30, with a sliding window 40, and a fixed window 42 mounted in the channels 31 and 32, respectively (see FIG. 3), and separated by a central support or divider member 43. As shown in FIG. 4B, the windows 40, 42, and the center divider 43 are removed in any conventional manner. It is well known that these window elements readily can be removed for repair and replacement purposes with a minimum of effort. The existing metal window frame 30 is left in place in the window opening, as indicated in FIG. 4B.

Figure 4C:
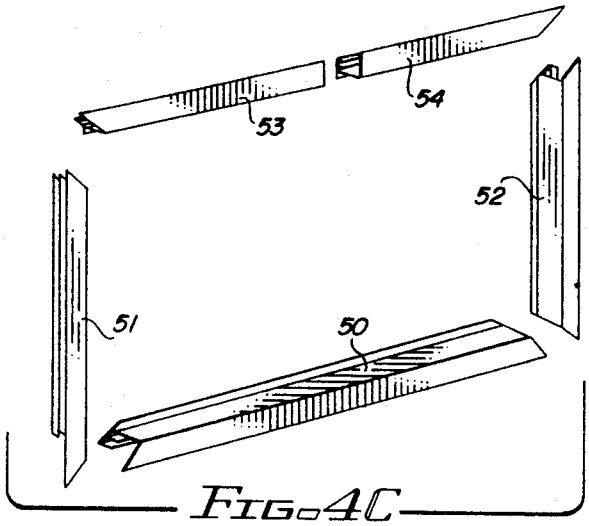

As shown in FIG. 4C, five cap members, including a bottom 50, first and second sides 51 and 52, and first and second top cap members 53 and 54, are cut from lengths of extrusions of the type shown in FIG. 1. The cap members 50, 51, and 52 are mitered at 45° on both ends. The lengths of these cap members are selected to fit the interior lengths or widths established by the upper edges of the flanges 33 and 34 of the existing metal frame 30 in the location where the new replacement window is to be installed. The top cap members 53 and 54 each comprise a length which is one-half the total length of the bottom member 50. These members are mitered at 45° on opposite ends, as illustrated in FIG. 4C, and are cut to abut one another at a 90° joint in the center.

Figure 4D:
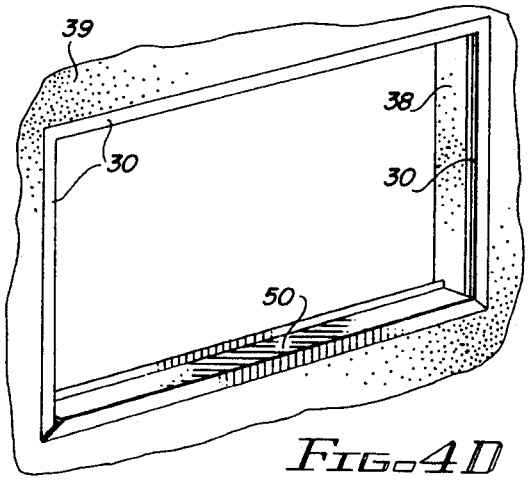

FIG. 4D then shows the first step in the installation of the cap 50 to form the new window frame over the existing metal frame 30 The cap 50 is simply put in place from the exterior or interior of the building over the existing frame, in the manner shown in FIG. 3. The side caps 51 and 52 then are put in place, as shown in FIG. 4E, again, from the exterior of the building. Where the mitered edges of the caps 51 and 52 engage the cap 50, they serve to secure the cap 50 in place without any additional fastener members. It is noted, from FIG. 3, that the inwardly turned legs or flanges 20 and 21 (or 18, or 19) serve to engage the surface of the flange 33 to prevent the cap members 50 to 54 from being pulled outwardly from the window opening, once they are in place.

Figure 5:
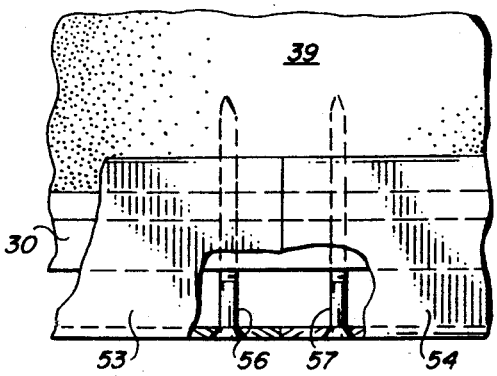
FIG. 5 illustrates structural details of the portion 5 circled in FIG. 4G.
Figure 4F:
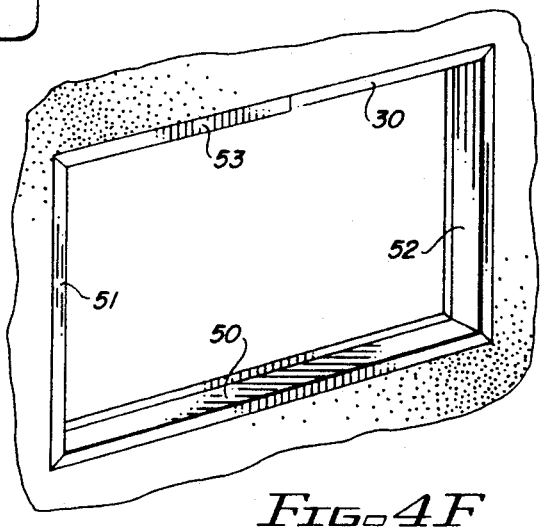
Figure 4E:
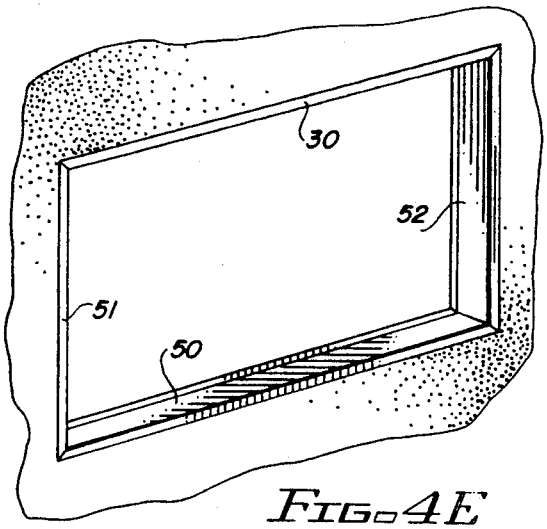
Figure 4G:
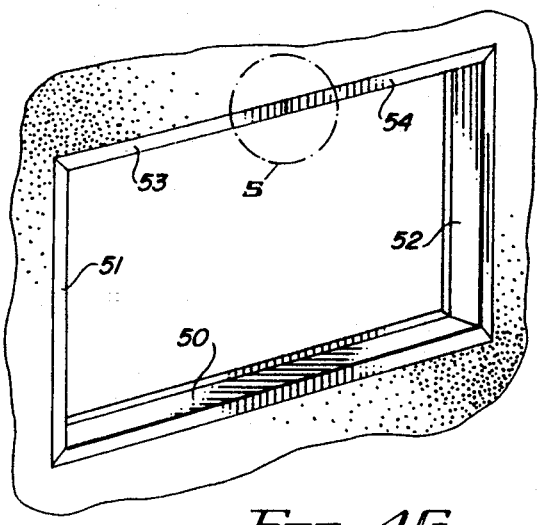

FIGS. 4F and 4G illustrate the final assembly steps in the installation of the replacement window frame cap assembly. The first one of the top members (shown as 53 in FIG. 4F) is placed in abutting relationship with the side cap member 51. This member 53 is installed by means of a suitable fastener, such as a screw 56, extended through the existing window frame into the underlying supporting structure 39, as illustrated most clearly in FIG. 5. Once the member 53 has been secured in place, the corresponding or matching member 54 is put in place and secured by means of a screw 57, again, as shown most clearly in FIG. 5. The two screws or fasteners 56 and 57, which are placed through the caps 53 and 54 comprising the top of the replacement window frame assembly, securely hold the entire assembly in place over the existing frame. The assembly cannot be removed by pushing it inwardly, because the lips 12 extend over the outside of the existing window frame. Similarly, the inwardly turned flanges or legs 18, 19, 20, or 21 engage the edge of the inner flange 33 to prevent the replacement window frame assembly from being pushed out of the pre-existing opening.

It is readily apparent from an examination of FIGS. 4A through 4G that installation of the extrusions forming the replacement window frame, do not interfere with or damage in any way, the exterior or interior structure of the building in which the replacement frame is placed.

The upwardly extending flange 14 with the inwardly turned upper edge 16 serves as an abutment for the insertion of a replacement window assembly into the new frame, which is shown in FIG. 4G. A suitable caulking compound or other sealant may be placed in the channel formed by the edge 16, and the inside edge of the surface 11; so that when the new replacement window is pressed into place in the opening, it abuts this surface on the top, bottom, and both sides of the replacement frame. The new window installation then may be secured by any suitable means to the cap members 50, 51, 52, 53, and 54, to complete the installation.

It should be noted that the entire installation of the cap members forming the replacement frame, as well as installation of the replacement window, is effected from the exterior of the building. This is an important feature for the effective remodeling which is brought about by means of the apparatus and method which is described above. No "mess" of any sort is made through the installation of replacement windows in accordance with the embodiment of the invention which has been described above, and which is shown in the drawings. Typically, the new windows, which are installed in the window frame illustrated in FIG. 4G, comprise double paned insulating windows, which significantly reduce heat loss compared with the single pane windows typically replaced. Of course, replacement of inefficient single pane windows is not the only reason for using the replacement windows and method described above, since in at least some instances replacement may be effected simply for a different decorative look.

The cap extrusion replacement window frame and method of installation described above, eliminate many costs otherwise associated with replacement of existing windows. There is no need to cut the interior drywall, which may have wallpaper, tile wood, wiring for the alarm system, mini blinds, and other window treatments already installed on it. Consequently, no patchwork inside the house is necessary.

When the exterior of a house or building is stucco or wood siding, or brick veneer, removal of a window frame usually requires the sawing of the window through the nailing fin. This means dealing with dust, debris, and construction cleanup. Since such sawing is not necessary with the invention described above, the expensive remodeling/construction time normally required is eliminated. In addition, the dust, debris and other construction cleanup are eliminated.

In buildings made of exterior stucco, the stucco is damaged on the returns in order to saw out an existing window frame. Patching and color matching after the removal and re-installation of a new window is a significant part of the installation of such a new window in stucco buildings. Since color matching cannot effectively be accomplished on wet stucco, it generally requires multiple trips to the job site to obtain the proper color match. Since the stucco of an existing building does not need to be broken or damaged in any way, through the use of the above described invention, considerable savings in the replacement of windows in stucco structures is effected through the use of the above described replacement window frame and method of installation. The foregoing description of the preferred apparatus and preferred method of installation should be considered as illustrative only, and not as limiting. For example, while aluminum extrusions appear to be the most efficient structure to use for the cap members, other techniques for forming the cap members, and other materials also may be employed. Various changes and modifications will occur to those skilled in the art, without departing from the true scope of the invention as defined in the appended claims.

What is claimed is:

1. A replacement window frame assembly for use in remodeling buildings in which the windows have been removed from existing window frames, said assembly including in combination:

bottom, top, and first and second side cap members each having an identical cross-section throughout the length thereof, with a front lip for overlapping the exterior of an existing window frame in a building, and each having a rear edge including a portion extending downwardly to overlap the interior of such existing window frame for abutting the sill, top and side walls, respectively, on the building interior of the opening in which the existing window frame is installed; and means for securing said cap members in place over the existing window frame.

2. The combination according to claim 1 wherein said cap members comprise a flat window frame overlying portion for orientation parallel to the bottom, top, and first and second sides, respectively, of the existing window frame in the building, and where said front lip extends downwardly from said flat portion, said flat portion, as well as said portion extending downwardly from said flat portion for abutting the sill, top, or side walls of the building interior.

3. The combination according to claim 1 wherein said bottom and side cap members each comprise lengths of uniform extrusions mitered at 45° angles at the ends thereof to fit in place over the existing window frame; said top cap member comprises first and second sections abutting one another at right angles at a location intermediate the ends of the top of the existing window frame, and mitered at 45° angles on the ends thereof to fit against said first and second side members in said installation; and said means for securing said cap members in place over the existing window frame comprises fasteners attaching said first and second top cap members to at least the existing window frame.

4. The combination according to claim 3 wherein said portion extending downwardly from said rear edge of said cap members comprises a substantially vertical wall portion thereon, terminating in an inwardly facing leg for resting on the sill, top and side walls surrounding the existing window frame.

5. The combination according to claim 1 further including means for adjusting the length of the front lip and of the portion extending downwardly from the rear edge of said cap members.

6. The combination according to claim 5 wherein said adjusting means comprises lines of weakening in said front lip and said portion extending downwardly from said rear edge of said cap members.

7. The combination according to claim 1 wherein said cap members are formed from uniform extrusions; and said top cam member is formed as first and second butting top members.

8. The combination according to claim 7 wherein said cap members are formed from sections of aluminum extrusions.

9. The combination according to claim 8 wherein said portion extending downwardly from said rear edge of said cap members comprises a substantially vertical wall portion thereon, terminating in an inwardly facing leg for resting on the sill, top and side walls surrounding the existing window frame.

10. The combination according to claim 1 wherein said cap members are formed from uniform extrusions; and said top cap member is formed as first and second butting top members.

11. The combination according to claim 10 wherein said cap members are formed from sections of aluminum extrusions.

12. The combination according to claim 11 further including means for adjusting the length of the front lip and of the portion extending downwardly from the rear edge of said cap members.

13. The combination according to claim 12 wherein said adjusting means comprises lines of weakening in said front lip and said portion extending downwardly from said rear edge of said cap members.

14. The combination according to claim 13 wherein said cap members comprise a flat window frame overlying portion for orientation parallel to the bottom, top, and first and second sides, respectively, of the existing window frame in the building, and where said front lip extends downwardly from said flat portion, and where said rear edge includes a portion extending upwardly from said flat portion, as well as said portion extending downwardly from said flat portion for abutting the sill, top, or side walls of the building interior.

15. The combination according to claim 14 wherein said bottom and side cap members each comprise lengths of uniform extrusions mitered at 45° angles at the ends thereof to fit in place over the existing window frame; said top cap member comprises first and second sections abutting one another at right angles at a location intermediate the ends of the top of the existing window frame, and mitered at 45° angles on the ends thereof to fit against said first and second side members in said installation; and said means for securing said cap members in place over the existing window frame comprises fasteners attaching said first and second top cap members to at least the existing window frame.

16. The combination according to claim 15 wherein said portion extending downwardly from said rear edge of said cap members comprises a substantially vertical wall portion thereon, terminating in an inwardly facing leg for resting on the sill, top and side walls surrounding the existing window frame.

17. A method for replacing windows in the window frames of existing buildings including the steps of:

removing the windows and intermediate support members from an existing window frame in a building interior, leaving the existing frame intact;

placing, in the order named, mitered, shaped cap members, each having identical cross sections throughout the length thereof, over the bottom sides and top of the existing window frame to overlie and conceal the existing window frame and to provide a new window frame for receiving a replacement window; and securing said cap members in place over the existing window frame.

18. The method according to claim 17 further including the step of providing said cap members from uniform extrusions having identical cross sections throughout the length thereof.

19. The method according to claim 17 further including the step of providing a lip on said cap members for providing an abutment surface of insertion of a new window into said new window frame from the outside of the building in which said new window frame is mounted.

20. The method according to claim 19 further including the step of providing said cap members from uniform extrusions having identical cross sections throughout the length thereof.

* * * * *